US005219262A

United States Patent [19]

Theurer et al.

[11] Patent Number: 5,219,262

[45] Date of Patent: Jun. 15, 1993

[54] FREIGHT CAR FOR TRANSPORTING AND STORING BULK MATERIAL

[75] Inventors: Josef Theurer, Vienna; Manfred Brunninger, Altenberg, both of Austria

[73] Assignee: Franz Plasser Bahnbaumaschinen Industriegesellschaft m.b.H., Vienna, Austria

[21] Appl. No.: 792,886

[22] Filed: Nov. 15, 1991

[30] Foreign Application Priority Data

Dec. 14, 1990 [AT] Austria ..... 2541/90

[51] Int. Cl.[5] ..... B65G 67/00

[52] U.S. Cl. ..... 414/505; 198/861.6; 414/339; 414/523; 414/528

[58] Field of Search ..... 414/339, 343, 345, 523, 414/502-505, 528; 198/861.6

[56] References Cited

U.S. PATENT DOCUMENTS

| | | | |
|---|---|---|---|
| 2,464,217 | 3/1949 | Dillingham | 414/523 |
| 2,670,836 | 2/1954 | Ball | 414/505 X |
| 4,289,439 | 9/1981 | Hansson | 414/505 X |
| 4,576,538 | 3/1986 | Theurer et al. | 414/339 |
| 4,701,095 | 10/1987 | Berryman et al. | 414/505 X |
| 4,742,938 | 5/1988 | Niewold | 414/505 X |
| 4,834,463 | 5/1989 | Nye | 414/523 X |
| 4,923,359 | 5/1990 | Petri et al. | 414/523 |
| 5,029,532 | 7/1991 | Snead | 414/339 X |

FOREIGN PATENT DOCUMENTS

| | | |
|---|---|---|
| 10176 | 11/1984 | European Pat. Off. . |
| 73133 | 5/1970 | German Democratic Rep. . |

*Primary Examiner*—David A. Bucci
*Attorney, Agent, or Firm*—Collard & Roe

[57] ABSTRACT

A freight car for transporting and storing bulk material, comprises an elongated frame supported on undercarriages running on a track, an elongated box mounted on the frame for storing the bulk material, a conveyor band at the bottom of the box for transporting the stored bulk material, the conveyor band extending in the longitudinal direction of the box and having an input end and an output end, and a transfer conveyor adjoining the conveyor band at the output end, the transfer conveyor extending in the longitudinal direction of the box and being arranged to receive the transported bulk material from the conveyor band. The transfer conveyor has a free discharge end projecting beyond the elongated frame and is freely pivotal transversely to the longitudinal direction about a vertical axis in a first range within the side walls of the box and a second range beyond the side walls. A blocking device is arranged for selectively limiting the first and second pivoting ranges of the transfer conveyor.

7 Claims, 1 Drawing Sheet

FREIGHT CAR FOR TRANSPORTING AND STORING BULK MATERIAL

BACKGROUND OF THE INVENTION

1. Field of the Invention

The present invention relates to a freight car for transporting and storing bulk material, which comprises an elongated frame supported on undercarriages running on a track having a loading gage, an elongated box mounted on the frame for storing the bulk material, the box having two side walls, an open top and a bottom, a conveyor band at the bottom of the box for transporting the stored bulk material, the conveyor band extending in the longitudinal direction of the box and having an input end and an output end, and a transfer conveyor adjoining the conveyor band at the output end, the transfer conveyor extending in the longitudinal direction of the box and being arranged to receive the transported bulk material from the conveyor band, the transfer conveyor having a free discharge end projecting beyond the elongated frame and being pivotal transversely to the longitudinal direction about a vertical axis.

2. Description of the Prior Art

U.S. Pat. No. 4,576,538, dated Mar. 18, 1986, discloses such a freight car and how any desired number of such freight cars may be advantageously coupled together to form a train along whose length bulk material may be transported and transferred from car to car by means of the transfer conveyors projecting from each car to the following car. Such a train may be used, for example, to transport the bulk material coming from a ballast cleaning machine from a rear car towards a lead car, using the bottom conveyor bands to transport the bulk material from an input to an output end within each box and the transfer conveyors to transfer the transported bulk material from the output to the input end of the next car. The free end of each transfer conveyor is detachably connectable with a centering device to the box of the next car adjacent the input end so that the transfer conveyor may be automatically pivoted about a vertical axis in track curves. This centering device assures that the free discharge end of the transfer conveyor is always centered over the box of the next car when the train moves in a track curve. For this purpose, the pivoting drive is kept in a freely floating position so that the centering device will automatically pivot the transfer conveyor in a track curve. The transfer conveyor of the front car is, of course, not connected to a centering device (since there is no car following this front car) and, for reasons of safety, this transfer conveyor is tied to the box to hold it in a substantially centered position and against pivoting about the vertical axis.

European patent No. 10,176, of Nov. 7, 1984, and German Democratic Republic patent No. 73,133, of May 12, 1970, disclose pivotal cranes mounted on a railroad car and equipped with blocking devices limiting the pivoting range of the crane. These patents do not address the problem of preventing an uncontrolled pivoting of a transfer conveyor in a freight car of the hereindescribed type while leaving the transfer conveyor free to pivot in track curves, on the one hand, and stopped in a substantially centered position, on the other hand, when the train is in transit and out of operation.

SUMMARY OF THE INVENTION

It is the primary object of this invention to provide a freight car of the first-described type, in which an unintended pivoting of the free end of the transfer conveyor outside the loading gage of the track is dependably prevented.

The "loading gage" of a railroad track is the width of a track within which railroad cars may run without interfering with trains in a neighboring track.

In a freight car for transporting and storing bulk material, which comprises an elongated frame supported on undercarriages running on a track having a loading gage, an elongated box mounted on the frame for storing the bulk material, the box having two side walls, an open top and a bottom, a conveyor band at the bottom of the box for transporting the stored bulk material, the conveyor band extending in the longitudinal direction of the box and having an input end and an output end, and a transfer conveyor adjoining the conveyor band at the output end, the transfer conveyor extending in the longitudinal direction of the box and being arranged to receive the transported bulk material from the conveyor band, the transfer conveyor having a free discharge end projecting beyond the elongated frame and being freely pivotal transversely to the longitudinal direction about a vertical axis in a first range within the side walls of the box and a second range beyond the side walls, the invention accomplishes this and other objects with a blocking device arranged for selectively limiting the first and second pivoting ranges of the transfer conveyor.

Such a blocking device, on the one hand, permits some lateral pivoting of the transfer conveyor within the first range, which is necessary for a proper functioning of the transfer conveyor in track curves, while preventing an uncontrolled pivoting of the transfer conveyor to a lateral position in which the free transfer conveyor end would be outside the loading gage of the track. It also permits the transfer conveyor of the front car to be blocked in a simple and rapid manner in its centered position, without requiring the time-consuming and laborious tying of this transfer conveyor with ropes or cables attaching the transfer conveyor to the box or frame of the front car. On the other hand, any transfer conveyor may be readily pivoted into a position wherein the free end thereof projects beyond the loading gage for unloading the stored bulk material at the side of the track simply by unblocking the blocking device. The blocking device is readily adaptable to all operating conditions.

The transfer conveyor has two side faces extending in the longitudinal direction, and the blocking device may comprise a support for the transfer conveyor, the support being affixed to the elongated frame between the vertical axis and the discharge end, and the support including a horizontal support beam extending transversely to the longitudinal direction, and two flaps pivoted to the support beam at respective ends thereof for engagement with the side faces of the transfer conveyor. This embodiment of the blocking device provides stable blocking and its operation may be readily viewed for easy control while, at the same time, serving as a support for the transfer conveyor. It has the further advantage of being readily retrofittable in existing freight cars of this type.

If the flaps are pivotal about axes extending in the longitudinal direction between a substantially horizontal unblocking position extending below an underside of the transfer conveyor and a substantially vertical blocking position extending alongside the side faces of the transfer conveyor for engagement of the flaps therewith, the flaps will securely hold the transfer conveyor against any pivoting movement in the blocking position while permitting the transfer conveyor to pivot outside the loading gage of the track in the unblocking position.

To enable the blocking device to assume three different, readily adjustable positions adapted to different operating conditions by simply pivoting the flaps, means may be provided for stopping each one of the flaps in an operating position between the unblocking and blocking positions, the flaps being transversely spaced from each other a distance permitting the transfer conveyor positioned between the flaps to be freely pivoted about the vertical axis within the second pivoting range. The freight stopping means may be bolts plugged into the blocking device, which will assure a rapid adjustability of the flaps as well as their secure stoppage in any adjusted position.

According to a preferred feature of this embodiment, a spindle is plugged into an upper end of each one of the flaps for engagement with the side faces of the transfer conveyor, which enables the transfer conveyor to be held tightly in a substantially centered position during transit of the freight car.

According to another embodiment of the present invention, the blocking device comprises a bolt longitudinally displaceably mounted on the frame and stoppable in selected positions of displacement and a rotatable disc connected to the transfer conveyor, the periphery of the disc defining notches engageable by the bolt upon longitudinal displacement thereof. This provides a very simple blocking device structure and the possibility of a remote control of the longitudinal displacement of the bolt to operate the blocking device.

BRIEF DESCRIPTION OF THE DRAWING

The above and other objects, advantages and features of this invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figure 1:
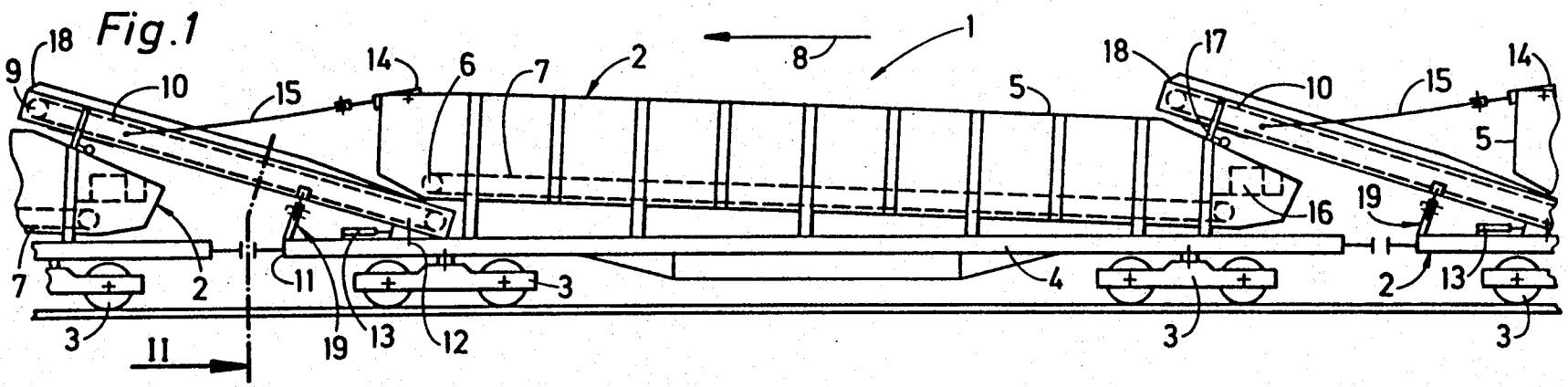
FIG. 1 is a side elevational view of a freight car incorporating the invention.

Referring now to the drawing and first to FIG. 1, there is shown freight train 1 comprised of a number of like freight cars 2 for transporting and storing bulk material, the cars being coupled together with buffers projecting from their facing ends. Each freight car 2 comprises elongated frame 4 supported on undercarriages 3 running on a track and elongated box 5 mounted on frame 4 for storing the bulk material, the box having two side walls, an open top and, in the illustrated embodiment, an open bottom. In this embodiment, the bottom of box 5 is constituted by conveyor band 7 at the open bottom of the box for transporting the stored bulk material, the conveyor band extending in the longitudinal direction of the box and having an input end and an output end. The conveyor band is driven by drive 6 in a conveying direction indicated by arrow 8. Transfer conveyor 10 is arranged adjoining conveyor band 7 at the output end, the transfer conveyor also extending in the longitudinal direction of box 5 and being arranged to receive the transported bulk material from the conveyor band. Transfer conveyor 10 is driven by drive 9 and has free discharge end 18 projecting beyond the elongated frame at buffer end 11 of the frame. Transfer conveyor 10 is freely pivotal transversely to the longitudinal direction on frame 4 about vertical axis 12 by pivoting drive 13. The transfer conveyor is pivotal within a first range within the side walls of box 5 and a second range beyond the side walls. The projecting free end of transfer conveyor 10 is supported by rope or cable 15 attaching the rope or cable to box 5 and being paid out by driven winch 14 which selectively shortens and lengthens the rope or cable connection of the transfer conveyor to the box. All the drives on freight car 2 are powered by central energy source 16 mounted on the car.

A centering device 17 is provided at the input end of bottom conveyor band 7 which holds the free end of a transfer conveyor of a preceding car centered over the input end of the conveyor band. According to the present invention, a blocking device is arranged between vertical pivoting axis 12 and discharge end 18 of transfer conveyor 10 for selectively limiting the first and second pivoting ranges of the transfer conveyor.

Figure 2:
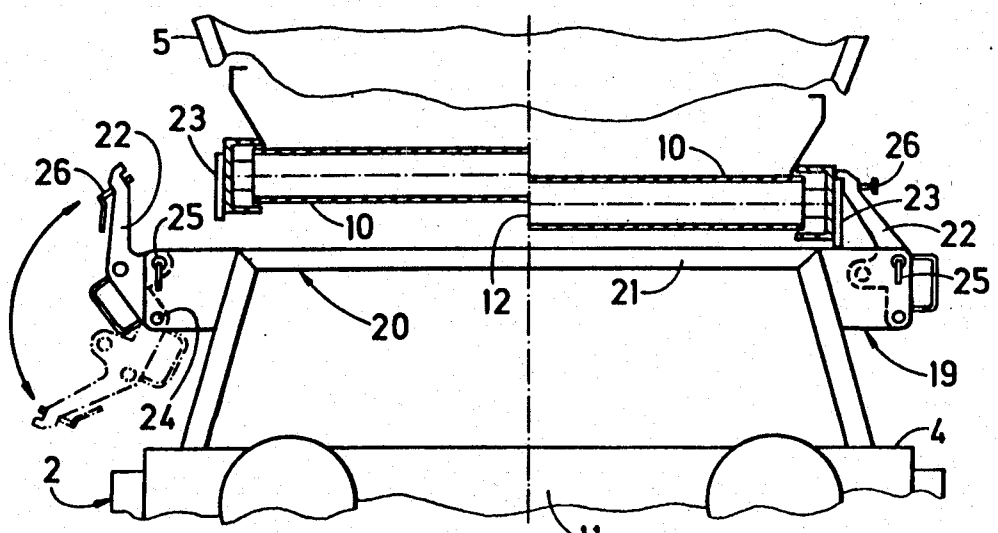
FIG. 2 is an enlarged cross section along line II of FIG. 1, showing the transfer conveyor in section and the blocking device in an end view.

In the embodiment illustrated in FIGS. 1 and 2, transfer conveyor 10 has two side faces 23 extending in the longitudinal direction, and blocking device 19 comprises support 20 for the transfer conveyor, the support being affixed to elongated frame 4 between vertical axis 12 and discharge end 18, and the support including horizontal support beam 21 extending transversely to the longitudinal direction. Two flaps 22 are pivoted to support beam 21 at respective ends thereof for engagement with side faces 23 of transfer conveyor 10. The flaps are pivotal about axes 24 extending in the longitudinal direction between a substantially horizontal unblocking position extending below an underside of the transfer conveyor (shown in phantom lines in FIG. 2) and a substantially vertical blocking position extending alongside the side faces of the transfer conveyor for engagement of the flaps therewith (shown in FIG. 2 in full lines at the right side).

As shown at the left side of FIG. 2 in full lines, blocking device 19 further comprises means for stopping each flap 22 in an operating position between the unblocking and blocking positions, the flaps being transversely spaced from each other a distance permitting transfer conveyor 10 positioned between flaps 22 to be freely pivoted about vertical axis 12 within the second pivoting range, i.e. within the loading gage of the track. In the illustrated embodiment, the stopping means comprises bolts 25 plugged selectively into two holes in blocking flaps 22 to hold the flaps on support 20 in the selected position. Threaded spindle 26 is plugged into an upper end of each flap 22 for tight engagement with side faces 23 of the transfer conveyor.

In transit, transfer conveyor 10 of front freight car 2 of train 1 is lowered by rope or cable drive 14, 15 onto support beam 21 and is blocked against lateral pivoting by engaging flaps 22 with side faces 23 and holding the flaps in the blocking position by plugging bolts 25 in the selected hole, as shown on the right side of FIG. 2. To prevent any lateral movement of the transfer conveyor, threaded spindles 26 are turned until side faces 23 are tightly engaged. In this way, transfer conveyor 10 is securely held on car frame 4 in a longitudinal direction. Flaps 22 of blocking devices 19 for the transfer conveyors of the succeeding freight cars are held in the above-described operating position shown in full lines at the left of FIG. 2, i.e. erect flaps 22 are spaced a sufficient distance from each other to enable the transfer conveyors, which are lifted slightly above support beams 21, to pivot freely within the range of the loading gage of the track. To make this free pivoting movement possible, hydraulic pivoting drive 13 is kept in the floating position, i.e. no hydraulic pressure is supplied to the hydraulic drive cylinder so that the piston can freely float therein. This enables the free discharge ends 18 of the transfer conveyors to be properly centered in track curves by their centering devices 17. Centering devices of this type are conventional, and a preferred centering device has been disclosed and claimed in our concurrently filed application Ser. No. 07/792,895, entitled "FREIGHT CAR FOR BULK MATERIAL". In case contact between centering device 17 and discharge end 18 of transfer conveyor 10 is lost for some reason, the blocking device will prevent uncontrolled pivoting of the transfer conveyor and will hold any pivoting movement within the range of the loading gage of the track. In this way, no transfer conveyor will ever project into the loading gage of a neighboring track. When it is desired to unload the bulk material from freight cars 2 to a storage place next to the track, i.e. outside its loading gage, bolt 25 is unplugged from flap 22 facing that side of the track and this flap is pivoted into its unblocking position shown in phantom lines in FIG. 2. Pressure is then applied to pivoting drives 13 of the transfer conveyors to pivot the transfer conveyors about axis 12 up to an angle of about 45°. Drives 6 and 9 are then actuated to drive conveyor bands 7 and transfer conveyors 10 to unload the freight cars.

Figure 3:
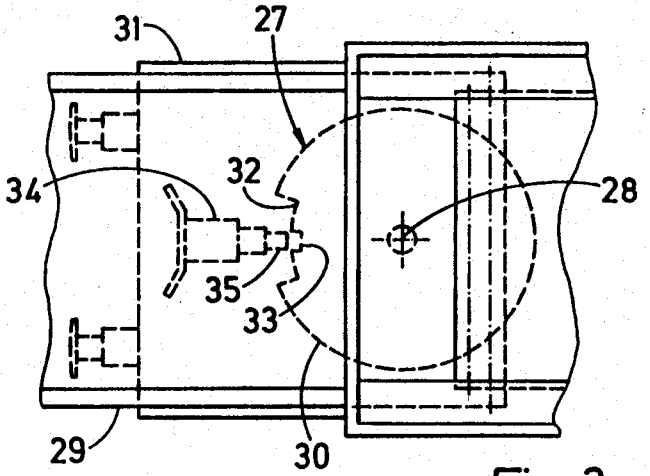
FIG. 3 is a fragmentary top view showing a portion of a transfer conveyor and another embodiment of a blocking device.

FIG. 3 illustrates another embodiment of this invention, wherein a blocking device 27 comprises a bolt 35 longitudinally displaceably mounted on frame 31 and stoppable in selected positions of displacement, and disc 30 rotatable about axis 28 by a drive (not shown). Disc 30 is connected to transfer conveyor 29. The periphery of disc 30 defines a wide notch 32 and a narrow notch 33 engageable by bolt 35 upon longitudinal displacement thereof. Drive 34, which may be remote-controlled, longitudinally displaces the bolt into engagement with notch 32 or 33, depending on the rotary position of disc 30, thus blocking the pivoting movement of transfer conveyor 29 within the above-described ranges.

What is claimed is:

1. A freight car for transporting and storing bulk material, which comprises (a) an elongated frame supported on undercarriages running on a track having a loading gage, (b) an elongated box mounted on the frame for storing the bulk material, the box having two side walls, an open top and a bottom, (c) a conveyor band at the bottom of the box for transporting the stored bulk material, the conveyor band extending in a longitudinal direction of the box and having an input end and an output end, (d) a transfer conveyor adjoining the conveyor band at the output end, the transfer conveyor extending in the longitudinal direction of the box and being arranged to receive the transported bulk material from the conveyor band, the transfer conveyor having a free discharge end projecting beyond the elongated frame and being freely pivotal transversely to the longitudinal direction about a vertical axis in a first range within the side walls of the box and a second range beyond the side walls, and (e) a blocking device arranged for selectively limiting the first and second pivoting ranges of the transfer conveyor.

2. The freight car of claim 1, wherein the transfer conveyor has two side faces extending in the longitudinal direction, and the blocking device comprises a support for the transfer conveyor, the support being affixed to the elongated frame between the vertical axis and the discharge end, and the support including a horizontal support beam extending transversely to the longitudinal direction, and two flaps pivoted to the support beam at respective ends thereof for engagement with the side faces of the transfer conveyor.

3. The freight car of claim 2, wherein the flaps are pivotal about axes extending in the longitudinal direction between a substantially horizontal unblocking position extending below an underside of the transfer conveyor and a substantially vertical blocking position extending alongside the side faces of the transfer conveyor for engagement of the flaps therewith.

4. The freight car of claim 3, further comprising means for stopping each one of the flaps in an operating position between the unblocking and blocking positions, the flaps being transversely spaced from each other a distance permitting the transfer conveyor positioned between the flaps to be freely pivoted about the vertical axis within the second pivoting range.

5. The freight car of claim 4, wherein the stopping means are bolts plugged into the blocking device.

6. The freight car of claim 2, further comprising a spindle plugged into an upper end of each one of the flaps for engagement with the side faces of the transfer conveyor.

7. The freight car of claim 1, wherein the blocking device comprises a bolt longitudinally displaceably mounted on the frame and stoppable in selected positions of displacement and a rotatable disc connected to the transfer conveyor, the periphery of the disc defining notches engageable by the bolt upon longitudinal displacement thereof.

* * * * *